US009675898B2

(12) United States Patent
DeVito

(10) Patent No.: US 9,675,898 B2
(45) Date of Patent: Jun. 13, 2017

(54) MODEL TOY TRAIN TRACK MODULE

(71) Applicant: John P. DeVito, Mount Prospect, IL (US)

(72) Inventor: John P. DeVito, Mount Prospect, IL (US)

( * ) Notice: Subject to any disclaimer, the term of this patent is extended or adjusted under 35 U.S.C. 154(b) by 166 days.

(21) Appl. No.: 14/693,492

(22) Filed: Apr. 22, 2015

(65) Prior Publication Data

US 2015/0298014 A1 Oct. 22, 2015

Related U.S. Application Data

(60) Provisional application No. 61/982,432, filed on Apr. 22, 2014.

(51) Int. Cl.
*A63H 18/02* (2006.01)
*A63H 19/30* (2006.01)

(52) U.S. Cl.
CPC ..... *A63H 18/02* (2013.01); *A63H 19/30* (2013.01)

(58) Field of Classification Search
CPC ..... A63H 19/30; A63H 18/02; Y10S 104/01
USPC ..... 238/10 E, 10 R, 10 A, 10 B, 10 C, 10 F
See application file for complete search history.

(56) References Cited

U.S. PATENT DOCUMENTS 3,074,647 A 1/1963 Bonanno
4,095,743 A * 6/1978 Birdsall ..... A63H 18/12 238/10 F
6,796,509 B1 9/2004 Webster et al.

FOREIGN PATENT DOCUMENTS

DE 29 46 890 * 5/1981
DE 2946890 A1 5/1981

OTHER PUBLICATIONS

LGB Adjustable Track.

* cited by examiner

*Primary Examiner* — Mark Le
(74) *Attorney, Agent, or Firm* — Wood, Phillips, Katz, Clark & Mortimer

(57) ABSTRACT

A model train track module including track rails supported on a plurality of adjacent connected track bed segments; and a biased connection between the track bed segments. The length of the track module in the direction of the track rails is biased from a minimum track dimension of S when the segments abut one another to a maximum track length of {S+([n−1]×s)}, where n is the number of track bed segments and s is the maximum distance between connected adjacent track bed segments when fully spaced apart. The track rails are adjustable in length and at the segment connections are connected by pins which have a top surface aligned with the top surface of the rail they connect.

15 Claims, 6 Drawing Sheets

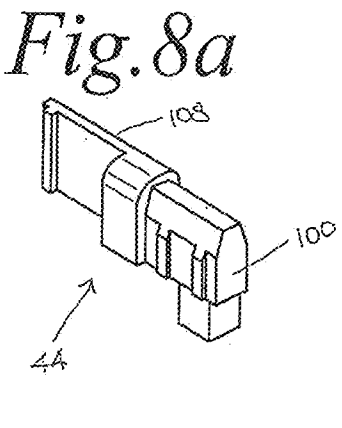
Fig. 8a
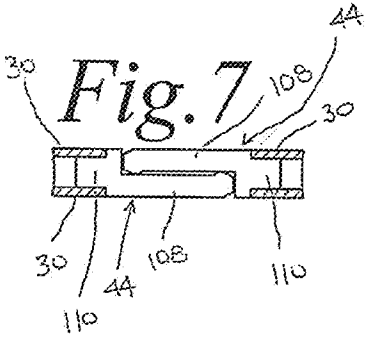
Fig. 7
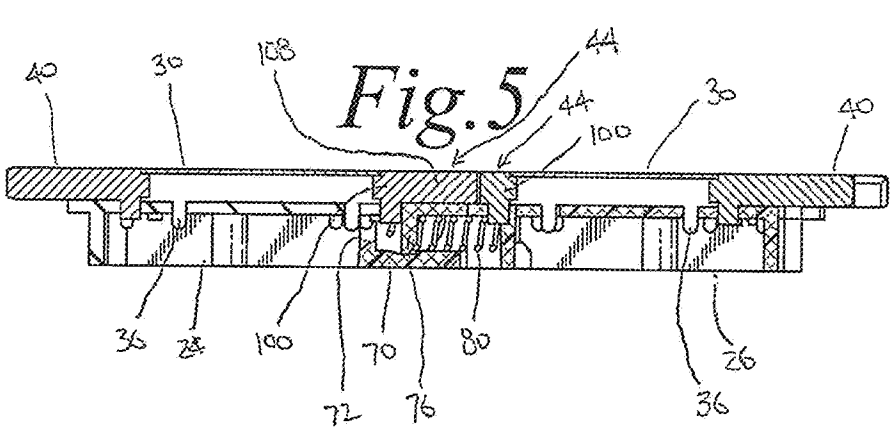
Fig. 5
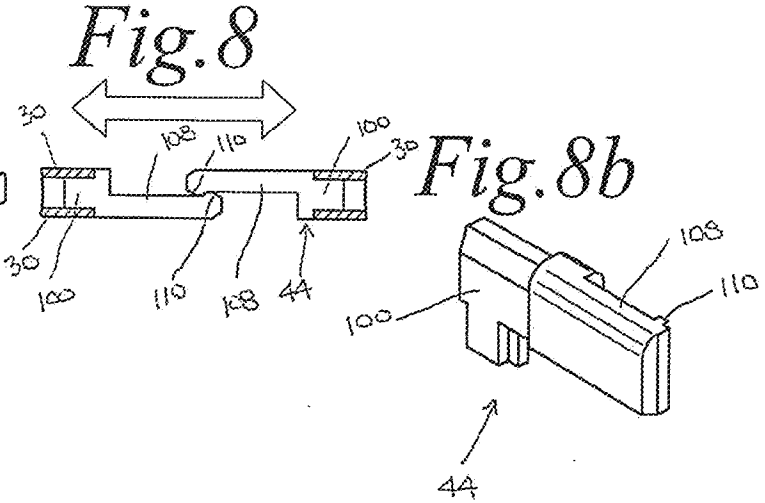
Fig. 8b
Fig. 8
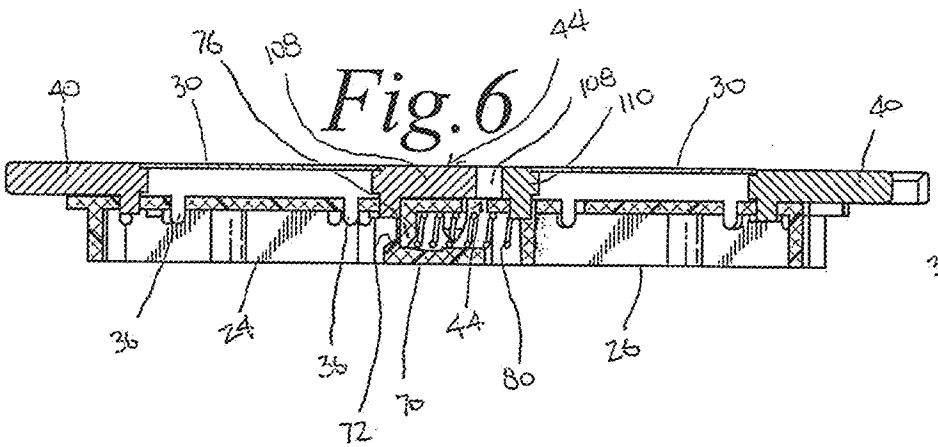
Fig. 6

MODEL TOY TRAIN TRACK MODULE

CROSS-REFERENCE TO RELATED APPLICATIONS

This is a non-provisional patent application claiming priority to U.S. Provisional Application Ser. No. 61/982,432, filed Apr. 22, 2014, entitled "Model Train Track Module", the entirety of which is hereby incorporated by reference.

FEDERALLY SPONSORED RESEARCH OR DEVELOPMENT

Not Applicable.

MICROFICHE/COPYRIGHT REFERENCE

Not Applicable.

FIELD OF THE INVENTION

The present invention relates to model toy trains, and more particular toward track modules for model toy trains.

BACKGROUND OF THE INVENTION

Model train railroad tracks with roadbeds are known in the toy train industry, as shown, for example, in U.S. Pat. Nos. 6,019,289 and 6,796,509.

Such tracks typically come in segments or modules which can be interconnected to provide the layout desired. Typically, such segments come in standard sizes which allow various combinations and orientations of the modules to be combined to create regular shapes, such as generally rectangular shapes with curved corners. However, in many layouts it is impossible and/or not desirable to have the tracks in only regular shapes, whether by design or by imperfections in laying out the tracks, particularly in the case of large layouts. Laying out tracks thus can in many instances results in a frustrating result akin to the old joke of the east and west railroads coming together from opposite directions such that their tracks will not align.

Accommodating such irregular alignments can require unintended bending of track modules, resulting in potentially damaging stresses, irregularities, and even gaps in the track module roadbed. Specially sized track modules shorter in length than the standard sizes have been used to fill gaps when the standard modules as laid out do not come together at some point. Unfortunately, this requires a large variety of such special modules in order to accommodate the wide variety of gap lengths that might arise in any layout. Further, even these special modules will not fill a gap where the directional orientations of the tracks do not align.

The present invention is directed toward providing an inexpensive, easy to use solution to track layout difficulties such as described above.

SUMMARY OF THE INVENTION

In one aspect of the present invention, a model train track module is provided, including track rails supported on a plurality of adjacent connected track bed segments; and a biased connection between the track bed segments. The length of the track module in the direction of the track rails is biased from a minimum track dimension of S when the segments abut one another to a maximum track length of $\{S+([n-1]\times s)\}$, where n is the number of track bed segments and s is the maximum distance between connected adjacent track bed segments when fully spaced apart.

In one form of this aspect of the present invention, the biased connection between adjacent track bed segments biases the adjacent connected track bed segments away from one another. In a further form, the biased connection between adjacent track bed segments consists of separate biasing springs on opposite sides of the module.

In another form of this aspect of the present invention, the track rails are adjustable in length. In a further form, one of the track rails carries electrical power, and the power carrying rail includes an adjustable connection between adjacent track bed segments, where the adjustable connection has a top surface aligned with the top surface of the rails it connects. In a further form, the adjustable connection of the power carrying rail includes a pin extending from the rail of one of the track bed segments, with the pin slidably engaging a corresponding pin extending from the rail of the adjacent track bed segment along a substantially vertical plane, wherein both of the pins have a top surface along their length aligned with the top surface of the power carrying rail from which it extends.

In still another form of this aspect of the present invention, n is an integer greater than 2.

In another aspect of the present invention, a model train track module includes track rails supported on "n" bed segments, the bed sections being arranged in sequence in the direction of the track rails wherein $n>2$. An adjustable connection between adjacent track bed segments biases adjacent track bed segments toward a spacing of "s" whereby the length of the track module may be adjusted by a distance $\{(n-1)\times s\}$.

In one form of this aspect of the present invention, the connection between adjacent track bed segments consists of separate biasing springs on opposite sides of the module.

In another form of this aspect of the present invention, the track rails are also adjustable in length. In a further form, one of the track rails carries electrical power, and the power carrying rail includes an adjustable connection between adjacent track bed segments, with the adjustable connection having a top surface aligned with the top surface of the rails it connects. In a still further form, the adjustable connection of the power carrying rail includes a pin extending from the rail of one of the track bed segments, with the pin slidably engaging a corresponding pin extending from the rail of the adjacent track bed segment along a substantially vertical plane, wherein both of the pins have a top surface along their length aligned with the top surface of the power carrying rail from which it extends.

In still another aspect of the present invention, a model train track module includes a plurality of track segments aligned end to end to extend in a lengthwise direction and at least one spring biasing the segments apart. Adjacent segments have lengthwise extending overlapping portions with one of the portions including a lip overlapping a flange of the adjacent segment in a direction lateral to the lengthwise direction to limit the spacing of adjacent segments.

In one form of this aspect of the present invention, the model train track module includes two compression springs between opposite sides of adjacent segments, and the overlapping portions of adjacent segments allow unequal spacing between the opposite sides of adjacent segments.

In another form of this aspect of the present invention, the plurality of track segments include segments at opposite ends of the module, and the end segments are identical to one another.

Other objects, features, and advantages of the invention will become apparent from a review of the entire specification, including the appended claims and drawings.

BRIEF DESCRIPTION OF THE DRAWINGS

FIG. 5 is a cross sectional view taken along line 5-5 of FIG. 3;

FIG. 6 is a cross sectional view taken along line 6-6 of FIG. 4;

FIG. 7 is a top view of the intermediate joint of the center rail of FIGS. 3 and 5;

FIG. 8 is a top view of the intermediate joint of the center rail of FIGS. 4 and 6;

FIGS. 8*a* and 8*b* are perspective views of the connecting intermediate pins of the joint of FIGS. 5-8;

DETAILED DESCRIPTION OF THE PREFERRED EMBODIMENT

Figure 1:
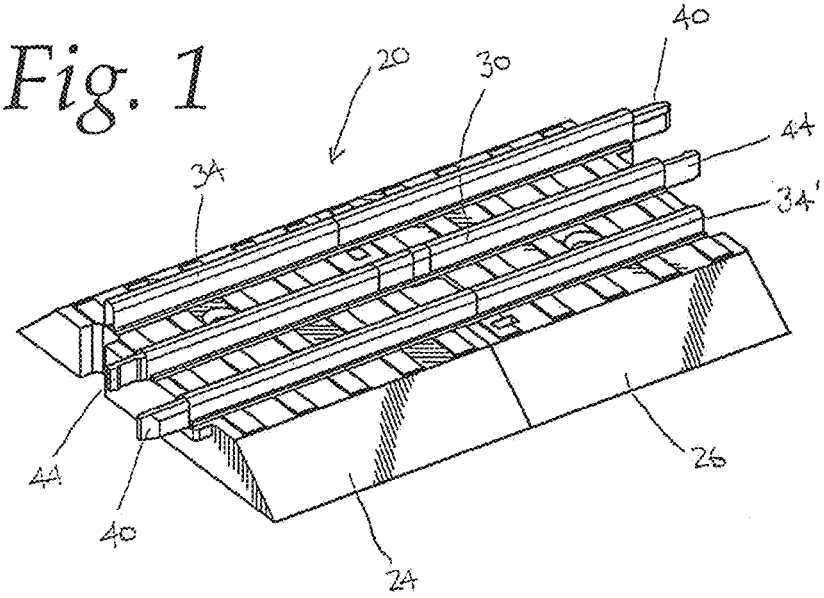
FIG. 1 is a perspective view of a track module according to the present invention, with two track bed segments.
Figure 2:
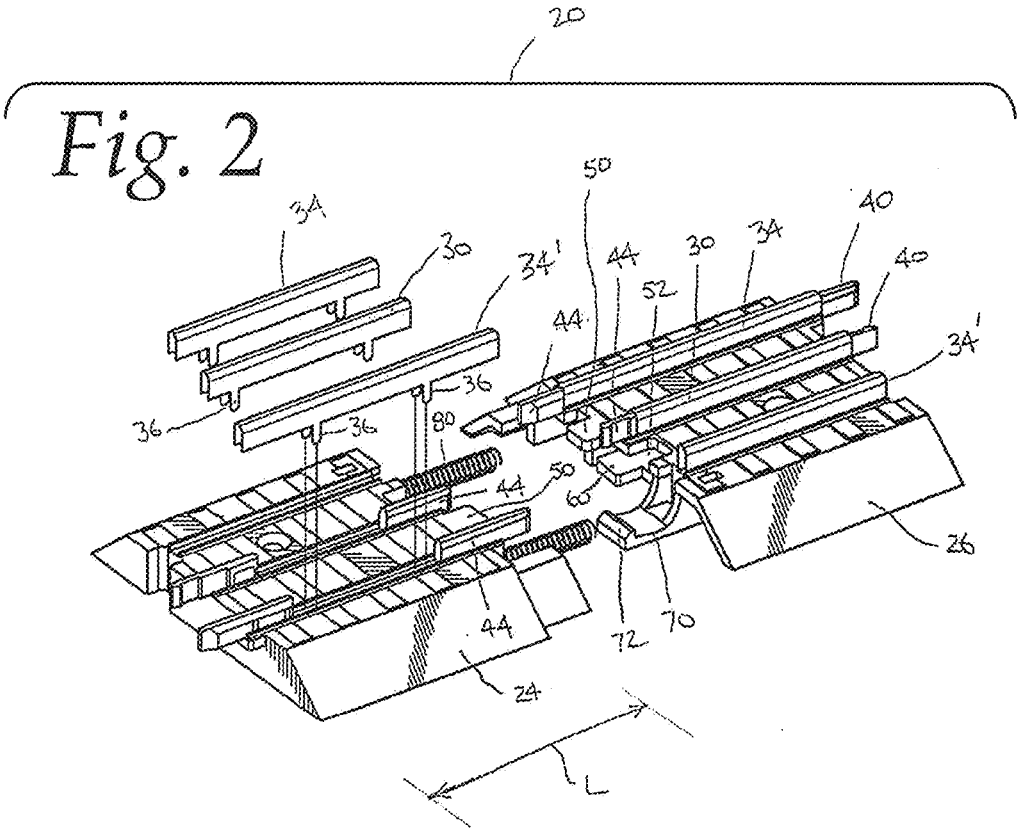
FIG. 2 is an exploded perspective view of the track module of FIG. 1.
Figure 3:
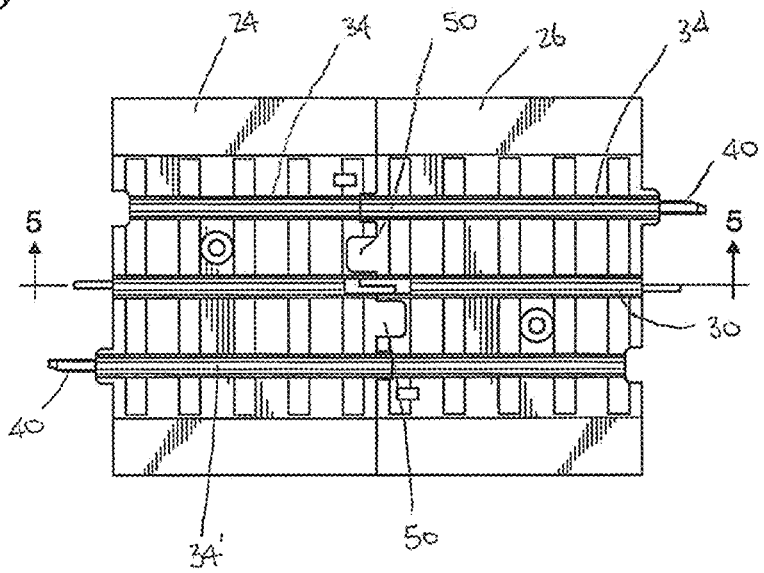
FIG. 3 is a top view of the FIG. 1 track module in a compressed, minimal length configuration.
Figure 4:
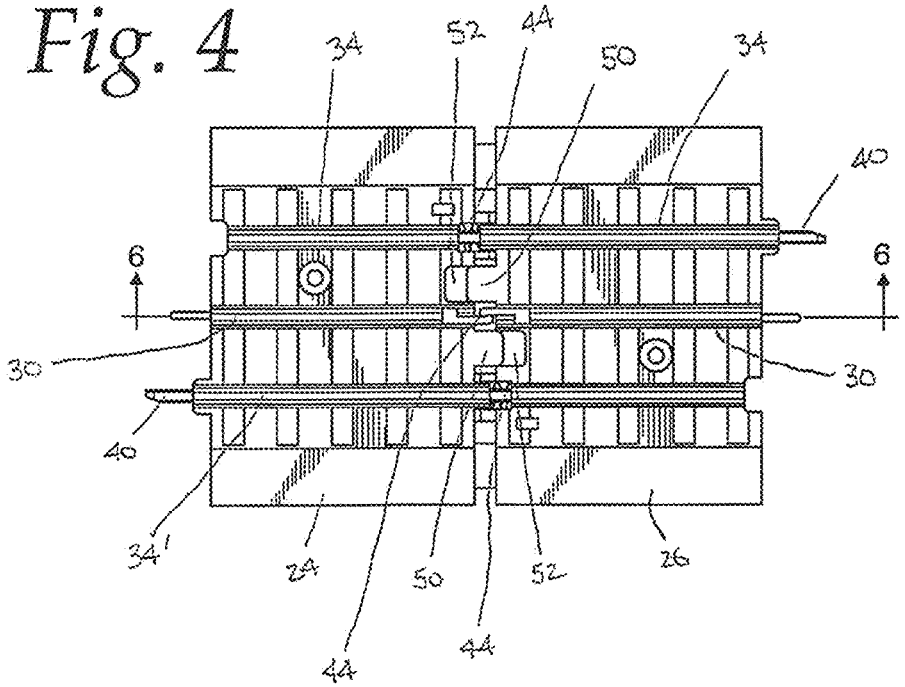
FIG. 4 is a top view similar to FIG. 3, showing the track module in an expanded configuration.

FIGS. 1-4 illustrate one embodiment of a track module 20 for use with model trains according to the present invention, including two track bed segments 24, 26. The track bed segments 24, 26 may advantageously be molded from non-conductive plastic, to provide the desired appearance of a railroad track bed while also allowing for secure support for connected rails, as well as allowing for safe, desirable electrical wiring and power supply. Advantageously, the track bed segments 24, 26 may be provided with lateral power supply lines for use with external design elements, such as LED track signals which may be plugged directly into a power supply outlet in one of the segments and/or remotely located elements such as lit billboards and/or roadside LED displays which may plug into such a power supply outlet near its location.

It should be appreciated that the track module 20 may be configured as necessary for ready connection to conventional tracks (see FIGS. 9-11) on either end, with one such configuration illustrated in the Figures. Use with different style tracks would, however, require different connection configurations on the ends, with those illustrated in the drawings being merely exemplary of one such configuration. The connection between track bed segments (e.g., 24 and 26) as disclosed herein is, however, advantageous for a plurality of reasons as described herein.

Figure 14:
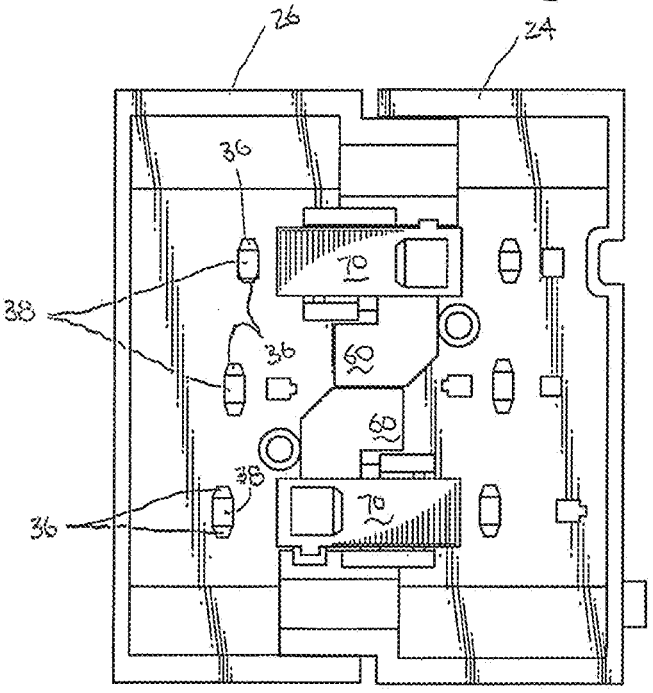
FIG. 14 is a bottom view of the two track segments of FIG. 13 assembled and in an expanded configuration.

As illustrated in FIG. 1, the track module 20 generally consists of the track bed segments 24, 26 supporting a center rail 30 between a pair of outer rails 34, 34'. In many layouts and model train types, the center rail 30 provides electric power to the train which has a power pick-up beneath the train locomotive which rides on top of the center rail 30. The rails 30, 34, 34' may have a substantially U-shaped hollow cross-section with a substantially flat top surface. Feet 36 (see FIG. 2) extend down from the sides of the rails 30, 34, 34' and extend through openings 38 in the segments 24, 26 (see FIG. 14), where the feet 36 are bent outwardly against the underside of the track bed segments 24, 26 to retain the rails 30, 34, 34' on the track bed segments 24, 26. (FIGS. 5-6 illustrate the feet 36 extending through the segment opening 38 prior to bending.)

At the ends of the track module 20, suitable pins 40 nesting in the outer rails 34, 34' may extend from the rails to be telescopically received in the rail of an adjacent track (see FIGS. 9-11) to help align the adjacent rails 30, 34, 34' so as to provide a continuous path. For example, pin configurations such as illustrated in U.S. Pat. No. 6,796,509 (the full disclosure of which is hereby incorporated by reference) may be used in this regard. However, an advantageous connection between the rails 30, 34, 34' of adjacent track bed segments 24, 26 by connecting pins 44 is described in greater detail below.

Advantageous adjustability between the track bed segments 24, 26 will now be described.

Figure 13:
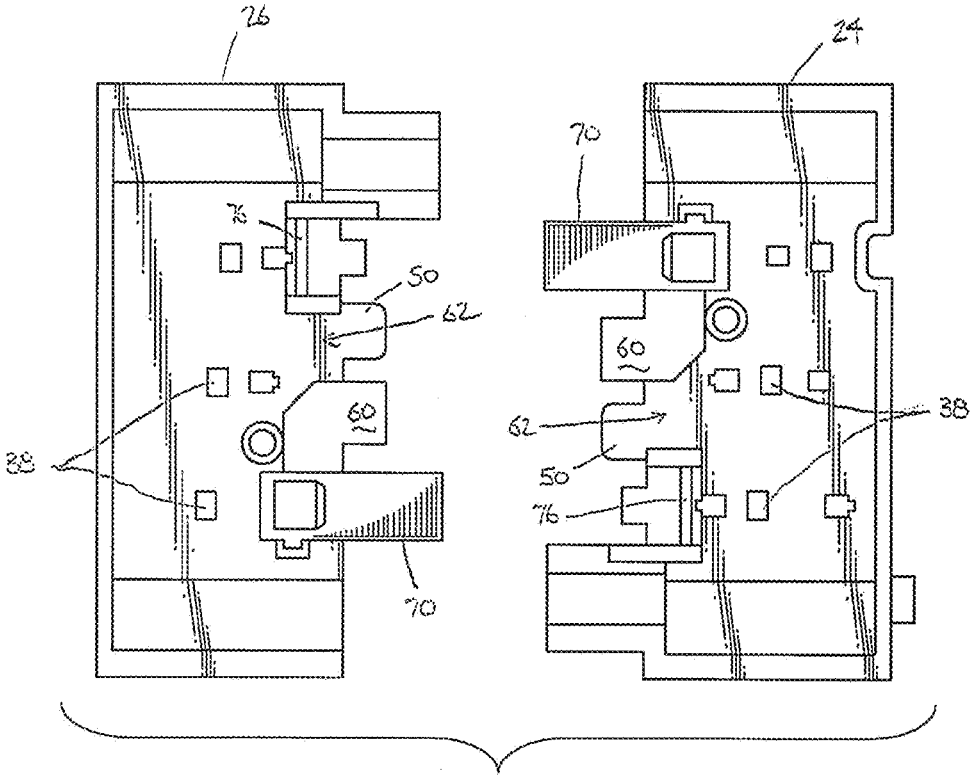
FIG. 13 is an exploded bottom view of two track segments according to the present invention.

The facing sides of adjacent track bed segments 24, 26 in the disclosed embodiment may advantageously be the same, with projections aligned with and received in corresponding slots so that the adjacent segments 24, 26 overlap, with some projections received in downwardly open slots and others received in upwardly open slots. For example, as particularly illustrated in FIG. 4, a top projection 50 extends from the end of the segments 24, 26 on one side of the center rail 30 and an upwardly open slot 52 is on the opposite side of the center rail 30 so that, when slid together, the top projection 50 of segment 24 is received in the slot 52 of segment 26, and the top projection 50 of segment 26 is received in the slot 52 of segment 24. Similarly, a lower projection 60 extends from each track bed segment 24, 26 and, when mated, fits into a downwardly open slot 62 as particularly illustrated in FIGS. 13-14.

It should thus be appreciated that adjacent track segments 24, 26 overlap so as to be secured relative to one another in the vertical direction. Further, it should be appreciated that the mating projections 50, 60 and slots 52, 62 provide some flexibility, whether as a result of some flexibility of the material and/or tolerances and relative sizing so that adjacent segments 24, 26 may not only move together and apart in the direction of the rails 30, 34, 34' but may also twist somewhat (i.e., adjacent track bed segments 24, 26 may be moved apart and/or together slightly different distances than the other side).

As best illustrated in FIGS. 2, 5, 6, 13 and 14, each segment 24, 26 includes a flexible arm 70 on one side of the center rail 30, with a lip 72 on the end of the arm 70. The arm 70 is aligned with a downwardly extending flange 76 on the adjacent segment 26, 24 such that, when the segments 24, 26 are mated together, the lip 72 will overlap with the flange 76 (see particularly FIG. 6) and thus retain the segments 24, 26 together and prevent them from being pulled apart in the horizontal direction. If it is desired to disassemble the segments 24, 26, the arms 70 could, of course, be manually manipulated to pull the lips 72 below the flange 76.

Advantageously, enclosures may be defined above the arms 70 and beneath the top of the segments 24, 26, each having a compression spring 80 abutting the flange 76 on one end and the base of the arm 70 on the other, whereby the force bearing on the opposite ends biases the track bed segments 24, 26 apart. The segments 24, 26 when pushed fully together thus are configured as illustrated in FIG. 5, and when biased fully apart, the segments 24, 26 are as illustrated in FIG. 6, with the lip 72 engaging the flange 76, with a range of possible spacing "s" between the segments. Providing such springs 80 on both sides of the track module 20 thus independently biases both sides apart, thereby allowing separate separation distances and thus some relative twisting as previously noted.

Thus, track modules 20 may accommodate a variety of different conditions which might be encountered in layouts. For example, a track module 20' having four track bed segments 24, 24', 26, 26' is illustrated in FIGS. 9-11 adjoining conventional tracks 90 having different non-standards alignments.

Figure 9:
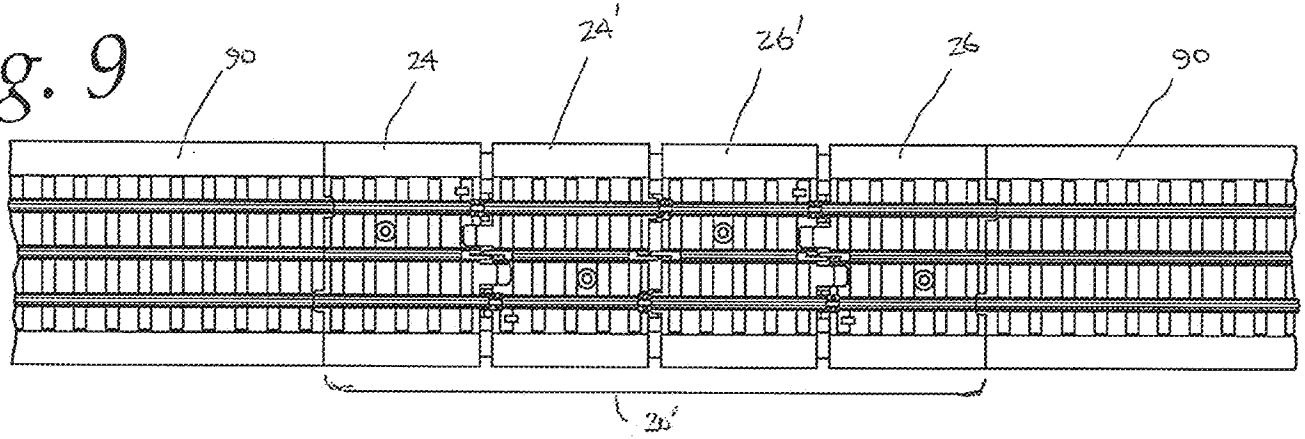
FIG. 9 is a top view of track module according to another embodiment of the present invention, with four track bed segments illustrated in a straight, expanded configuration between two conventional track modules.

FIG. 9 illustrates the track module 20' filling a gap "S" between two aligned conventional tracks 90. It should be appreciated that when each segment has an effective length "L", a four segment track module 20' may reliably fit a gap "S" in the range of 4L to 4L+3s.

Figure 10:
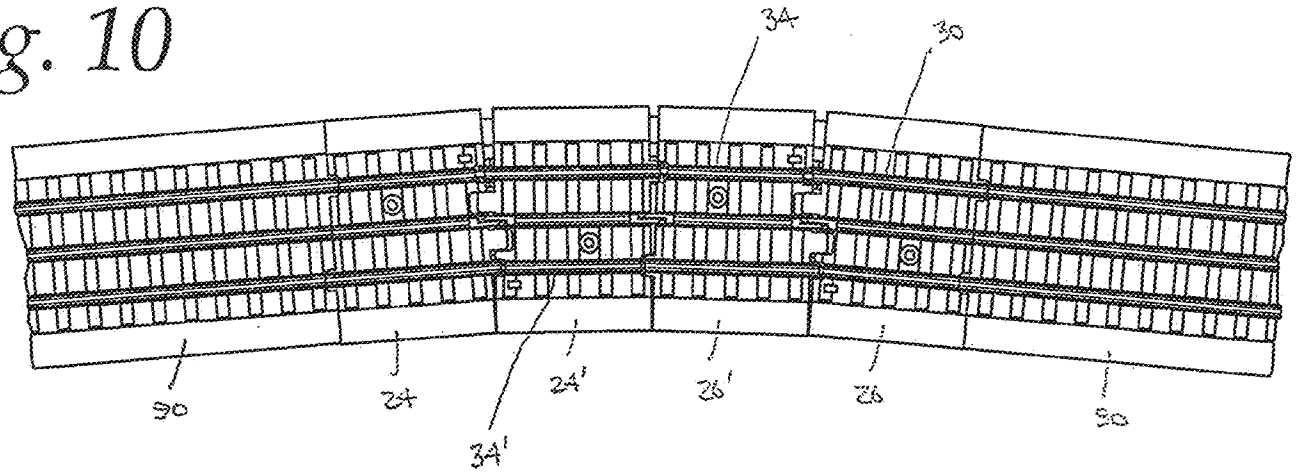
FIG. 10 is a view similar to FIG. 9, with the track bed segments twisted relative to one another to connect two conventional track modules which are at angles relative to each other.
Figure 11:
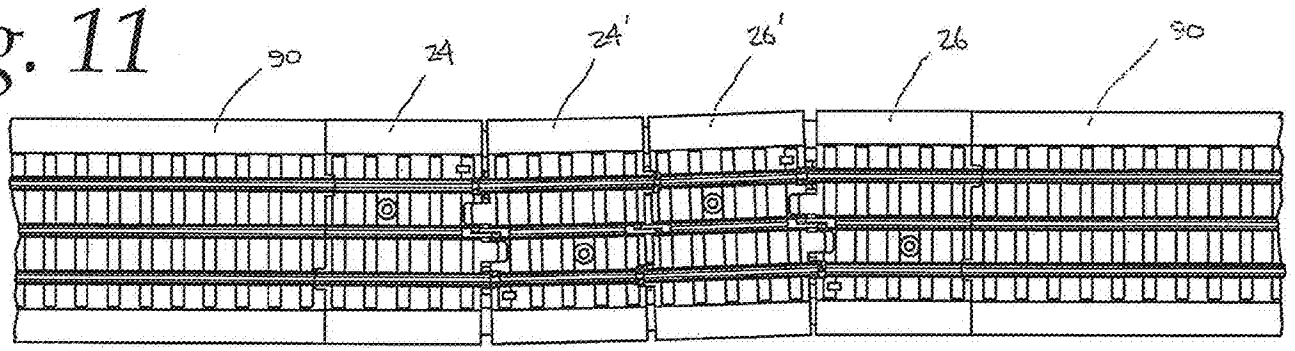
FIG. 11 is a view similar to FIGS. 9 and 10, with the track bed segments twisted in a slight S configuration to connect two conventional track modules which are parallel but misaligned.
Figure 12:
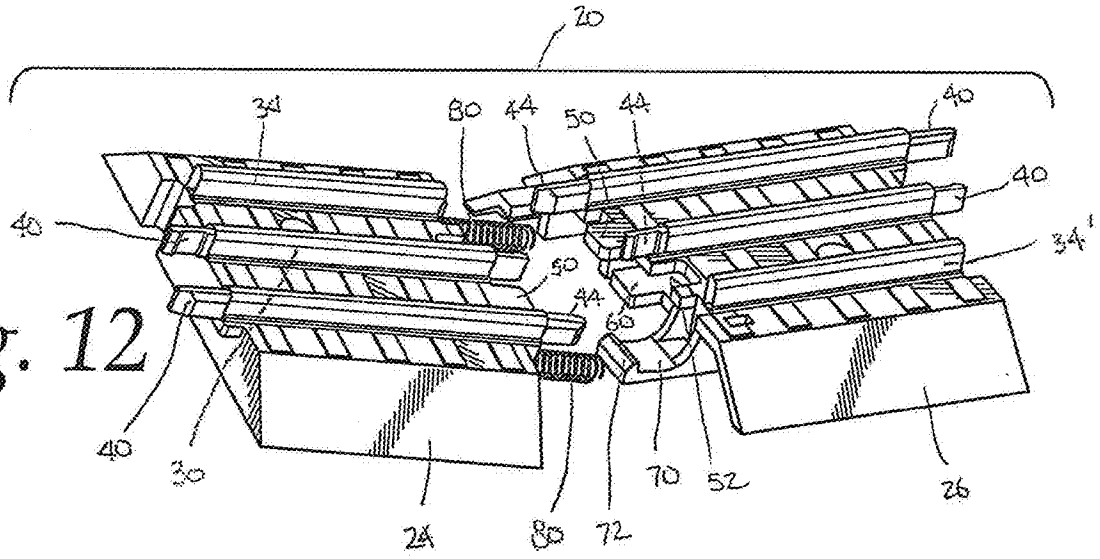
FIG. 12 is a perspective view of two track segments according to the present invention illustrating assembly of the track segments together.

Further, as illustrated in FIGS. 10 and 11, not only may such track modules 20 readily fit a range of gaps, but the relative twisting of adjacent segments 24, 26 may similarly allow such modules 20 to accommodate slight curves where necessary to connect misaligned (FIG. 11) and/or slightly angled (FIG. 10) tracks 90 in a layout.

Reference will now be had to the connection of the rails 30, 34, 34' between the adjustable track bed segments 24, 26 by connecting pins 44. Details of these connecting pins 44 are not illustrated in the Figures for the outer rails 34, 34', with such detail being shown in the Figures for the center rail 30, but it should be understood that the same configuration of connecting pins 44 can advantageously be used with the outer rails 34, 34' as well.

Specifically, as particularly shown in FIGS. 5-8 and 8*a-b*, the connecting pins 44 (which may be of electrically conductive material) include a base 100 which is suitably secured to a track bed module 24, 26, with the base 100 also received inside the U-shaped hollow of the associated rail 30. The portions of the pins 44 extending out of the rail U-shaped hollow expand out on both sides and on the top a distance substantially equal to the thickness of the bent material forming the rail 30, 34, 34' to present a top surface 104 in particular which is aligned with the top surface of the rails 30, 34, 34'. A uniform top surface of the rails 30, 34, 34' and pins 44 thus ensures constant good electrical contact and thus electrical "continuity" between the locomotive and any power supplying rail 30, 34, 34' even through the spaces where the rail is defined by the connecting pins 44.

The connecting pins 44 also include longitudinal ends 108 which are reduced in width (see FIGS. 7, 8 and 8*a-b*) so that the ends 108 extending from adjacent track bed segments 24, 26 slidably engage one another along a generally vertical plane. A lip 110 may also be advantageously provided on the longitudinal ends 108 to facilitate a conductive contact between the pins 44 even when the track bed segments 24, 26 are slightly twisted such as previously described and shown in FIGS. 10-11. Conventional pin connections could in some layouts be used to connect some rails of the track bed segments 24, 26 should the above advantages of the connecting pins 44 not be required.

It should be appreciated that the provision of a relatively few number of track modules may facilitate connection of a virtually infinite variety of gaps in conventional tracks layouts. Moreover, it should similarly be appreciated that providing identical mating sides for adjacent segments would allow track modules of three or more segments to be provided with only two module configurations—a center configuration, such as 24', 26' in FIGS. 9-11 and an end configuration such as 24, 26.

Assembly of such segments as needed for a particular layout could be easily done by the layout builder as the need is encountered, without requiring special designs or "make do" pieces when such connection issues are encountered. Moreover, it should be appreciated that the module 20 will automatically fit itself appropriately into the encountered shape by the action of the biasing compression springs.

Additionally, it should be appreciated that advantageous track modules according to the present invention could be used with a variety of track and locomotive types and sizes, including designs with more or less than three rails.

The invention claimed is:

1. A model train track module having a minimum track dimension "S", comprising:

track rails extending in a direction and supported on "n" adjacent connected track bed segments, wherein connected adjacent track bed segments have a maximum distance apart "s" in said direction; and a biased connection between the track bed segments whereby the length of the track module in the direction of the track rails is biased from the minimum track dimension "S" when the segments abut one another to a maximum track length of $\{S+([n-1]\times s)\}$.

2. The model train track module of claim 1, wherein the biased connection between adjacent track bed segments biases the adjacent connected track bed segments away from one another.

3. The model train track module of claim 2, wherein the biased connection between adjacent track bed segments comprises separate biasing springs on opposite sides of the module.

4. The model train track module of claim 1, wherein said track rails are adjustable in length.

5. The model train track module of claim 4, wherein one of said track rails carries electrical power, and said power carrying rail includes an adjustable connection between adjacent track bed segments, said adjustable connection having a top surface aligned with the top surface of the rails it connects.

6. The model train track module of claim 5, wherein said adjustable connection of said power carrying rail includes a pin extending from the rail of one of said track bed segments, said pin slidably engaging a corresponding pin extending from the rail of the adjacent track bed segment along a substantially vertical plane, wherein both of said pins have a top surface along their length aligned with the top surface of the power carrying rail from which it extends.

7. The model train track module of claim 1, wherein n is an integer greater than 2.

8. A model train track module, comprising:

track rails extending in a direction and supported on "n" bed segments, said bed sections being arranged in sequence in the direction of the track rails wherein n>2;

an adjustable connection between adjacent track bed segments, said connection biasing said adjacent track bed segments toward a spacing of "s" whereby the length of the track module is adapted to be adjusted by a distance up to {(n−1)×s}; and springs on opposite sides of connected adjacent track bed segments biasing the adjacent track bed segments apart.

9. The model train track module of claim 8, wherein said track rails are adjustable in length.

10. The model train track module of claim 9, wherein one of said track rails carries electrical power, and said power carrying rail includes an adjustable connection between adjacent track bed segments, said adjustable connection having a top surface aligned with the top surface of the rails it connects.

11. The model train track module of claim 10, wherein said adjustable connection of said power carrying rail includes a pin extending from the rail of one of said track bed segments, said pin slidably engaging a corresponding pin extending from the rail of the adjacent track bed segment along a substantially vertical plane, wherein both of said pins have a top surface along their length aligned with the top surface of the power carrying rail from which it extends.

12. A model train track module, comprising:

a plurality of track segments aligned end to end to extend in a lengthwise direction, adjacent segments having lengthwise extending overlapping portions with one of said portions including a lip overlapping a flange of the adjacent segment in a direction lateral to said lengthwise direction to limit spacing between adjacent segments; and at least one spring biasing said segments apart.

13. The model train track module of claim 12, wherein said at least one spring comprises two compression springs between opposite sides of adjacent segments, and said overlapping portions of adjacent segments allow unequal spacing between said opposite sides of adjacent segments.

14. The model train track of claim 12, wherein said plurality of track segments include segments at opposite ends of said module, and said end segments are identical to one another.

15. A model train track module, comprising:

track rails supported on a plurality of adjacent connected track bed segments; and biased connections between the track bed segments whereby the length of the track module is biased from a minimum track dimension of S when the segments abut one another to a maximum track length of {S+([n−1]×s)}, where n is the number of track bed segments and s is the maximum distance between connected adjacent track bed segments when fully spaced apart;

wherein one of said track rails carries electrical power and includes adjustable connections between adjacent track bed segments, each adjustable connection including a pin extending from the rail of one of said track bed segments and slidably engaging a corresponding pin extending from the rail of the adjacent track bed segment along a substantially vertical plane, wherein both of said pins have a top surface along their length aligned with the top surface of the power carrying rail from which it extends.

* * * * *